US005920330A

United States Patent [19]

Ikezaki

[11] Patent Number: 5,920,330

[45] Date of Patent: Jul. 6, 1999

[54] INK JET PRINTER CAPABLE OF PERFORMING PRINTING IMMEDIATELY AFTER THE END OF A WIPING OPERATION

[75] Inventor: Yoshiyuki Ikezaki, Nagoya, Japan

[73] Assignee: Brother Kogyo Kabushiki Kaisha, Nagoya, Japan

[21] Appl. No.: 08/751,768

[22] Filed: Nov. 8, 1996

[30] Foreign Application Priority Data

Nov. 20, 1995 [JP] Japan ..... 7-326525

[51] Int. Cl.[6] ..... B41J 2/165; B41J 29/38

[52] U.S. Cl. ..... 347/33; 347/17

[58] Field of Search ..... 347/33, 17, 19, 347/88, 44, 23

[56] References Cited

U.S. PATENT DOCUMENTS 5,043,741 8/1991 Spehrley, Jr. ..... 347/88

5,386,224 1/1995 Deur et al. ..... 347/7

FOREIGN PATENT DOCUMENTS 4-257451 9/1992 Japan ..... 347/33

5-84901 4/1993 Japan ..... 347/88

50345415 12/1993 Japan ..... 347/88

6-115074 4/1994 Japan ..... 347/17

*Primary Examiner*—N. Le

*Assistant Examiner*—Thien Tran

*Attorney, Agent, or Firm*—Oliff & Berridge, PLC

[57] ABSTRACT

An ink jet printer capable of printing just after the end of wiping is provided. Electric power to be fed to a front heater which is for heating a nozzle is increased in advance of a wiping motion performed by a wiping device. The heat removed from the nozzle portion by contact of the nozzle portion with wiping paper is replenished with the front heater to prevent drop of the nozzle temperature.

20 Claims, 7 Drawing Sheets

INK JET PRINTER CAPABLE OF PERFORMING PRINTING IMMEDIATELY AFTER THE END OF A WIPING OPERATION

BACKGROUND OF THE INVENTION

1. Field of the Invention

The present invention relates to an ink jet printer of a hot melt type for heat-melting a solid ink stored in an ink tank and ejecting the resulting liquid ink to effect printing.

2. Description of Related Art

Known heretofore is a hot melt type ink jet printer that heats and melts a solid ink and performs printing by using the resulting liquid ink. In the use of such a solid ink, ink sediment and dust are apt to be deposited on a nozzle surface of an ink jet head, and air is apt to stay in passages within the ink jet head. Consequently, the orifice of the nozzle is apt to be clogged. This clogging of the orifice has heretofore been a cause of bad influence on the print quality.

In an effort to eliminate such inconvenience there have been proposed cleaning methods involving cleaning of the ink jet head periodically or as necessary to maintain the required performance of the ink jet. For example, one method uses replaceable cleaning paper that is disposed face to face with the nozzle of the ink jet head and is brought into contact with the ink jet head under the application of a predetermined certain force to wipe off the deposited ink. Another method uses a cleaning device in which ink is ejected forcibly from the nozzle, thereby allowing dust and air included in the nozzle to be adhered to the aforesaid cleaning paper spaced slightly from the nozzle. This method is disclosed in, for example, Japanese Unexamined Patent Publication Nos. Sho 62-25056 (1987) and Hei 5-42677 (1993).

However, in the case where wiping is performed while allowing a wiping member such as cleaning paper to be in contact with the ink jet head, the heat of the nozzle portion and the vicinity thereof is removed by the cleaning paper or the like, resulting in the nozzle temperature dropping. Thus, printing cannot be done until elevation of the nozzle temperature. In the foregoing Japanese Unexamined Patent Publication No. Hei 5-42677 it is described to heat the cleaning paper. But even with mere heating of the cleaning paper, unless the heating temperature is above the nozzle temperature, there will arise a drop in temperature of the nozzle portion due to the wiping operation.

SUMMARY OF THE INVENTION

It is an object of the present invention to provide an ink jet printer which can perform printing immediately after the end of wiping for an ink jet head.

According to the present invention, there is provided an ink jet printer comprising an ink jet head which heats and melts a solid ink stored in an ink tank and which ejects the resulting liquid ink through a nozzle to effect printing, wiping means having a wiper member for performing a wiping operation to clean a nozzle surface of the ink jet head, wiping control means for controlling the operation of the wiping means, heater means for heating the nozzle portion of the ink jet head, and heater control means which receives a signal from the wiping control means and which, at least during the wiping operation, increases the amount of heat produced by the heater means.

According to the present invention, when the start of a wiping operation by the wiping means is detected with a signal provided from the wiping control means, the amount of heat produced by the heater means is increased during the wiping operation by the heater control means, whereby the drop in temperature of the nozzle portion caused by the wiping operation is prevented. In the normal condition the heater means heat-melts the solid ink and maintains the temperature of the resulting liquid ink in the nozzle portion at a level at which the viscosity of the ink is suitable for the ejection of the ink. In the wiping operation, the amount of heat produced by the heater means is increased to prevent the drop of the ink temperature in the nozzle portion due to contact of the wiper member with the nozzle surface.

Thus, according to the present invention, the amount of heat produced by the heater means which heats the nozzle portion is increased at least during the wiping operation, so that the drop in temperature of the nozzle portion caused by the wiping operation can be prevented. Hence it is possible to start printing immediately after the end of the wiping operation. The heater means normally functions to heat-melt the solid ink into a liquid phase and maintain the ink temperature at a level at which the ink viscosity in the nozzle portion is suitable for the ejection of the ink. In the wiping operation, however, the amount of heat produced by the heater means is increased, thereby making it possible to prevent the drop of the ink temperature in the nozzle portion caused by contact of the wiper member with the nozzle surface.

In the present invention, moreover, the heater control means receives a signal from the wiping control means and increases the electric power to be fed to the heater means in advance of the wiping operation. According to this construction, since the heating is made prior to the wiping operation, it is possible to attain the rise of temperature before start of the wiping operation, whereby the solidification or increase in viscosity of the ink caused by contact of the wiping member with the nozzle surface can be effectively avoided.

According to the present invention, the heater means comprises a main heater for maintaining the ink in the ink jet head in a molten condition and a sub-heater for heating the nozzle portion. The heater control means makes control in such a manner that the main heater normally heats the ink in the ink jet head so as to keep the ink melted and that the sub-heater is operated to heat the nozzle portion when the heater control means receives a signal from the wiping control means. By so doing, the amount of heat produced by the heater means can be increased efficiently at least during the wiping operation.

According to the present invention, upon receipt of a signal from the wiping control means, the heater control means makes control to increase the electric power to be fed to the heater means at least during the wiping operation, whereby the amount of heat produced by the heater means can be increased at least during the wiping operation.

According to the present invention, the heater control means is constructed so that the heating temperature of the heater means is controlled by duty control. More specifically, at least during the wiping operation, the duty ratio of a duty signal is increased by the heater control means. Consequently, by a mere change of a control signal it is made possible to easily increase the electric power to be fed to the heater means.

Further, according to the present invention, the wiper member is in the form of a sheet and moves relative to the nozzle portion of the ink jet head while closely contacting with the nozzle portion, thereby cleaning the nozzle surface.

In this case, the heat removed from the nozzle surface upon such close contact of the wiper member with the nozzle surface can be replenished by the heater means because the amount of heat produced by the heater means is increased at least during the wiping operation.

BRIEF DESCRIPTION OF THE DRAWINGS

Preferred embodiments of the present invention will be described in detail with reference to the following figure wherein.

DETAILED DESCRIPTION OF PREFERRED EMBODIMENTS

Figure 1:
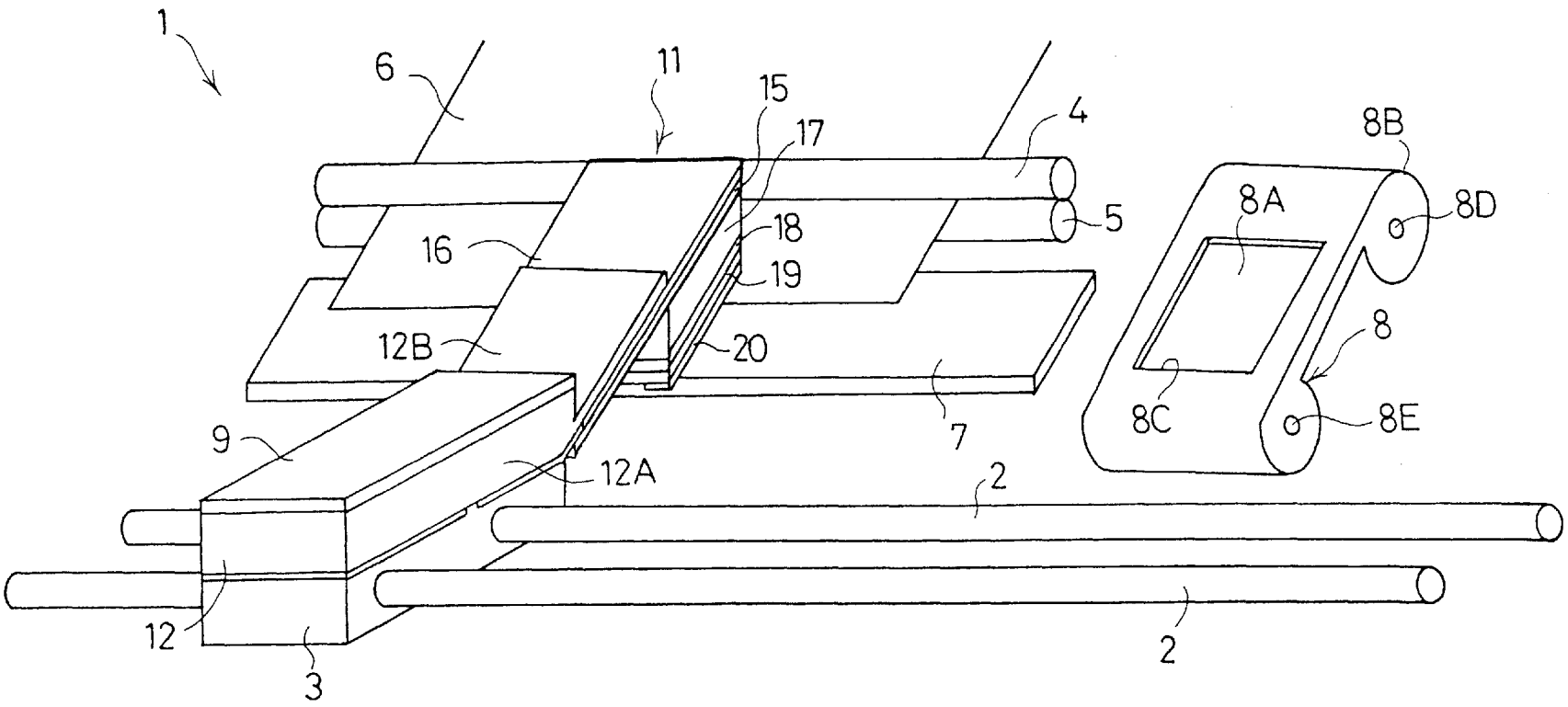
FIG. 1 is a perspective view of a hot melt type ink jet printer embodying the present invention.

FIG. 1 is a perspective view of a hot melt type ink jet printer. In the figure, the ink jet printer 1 has an ink jet head 11 of a hot melt type which heat-melts a solid ink (melting, say, at 70 to 80° C.) and ejects the resulting liquid ink (ink temperature of, say, 125° C.) through a nozzle to effect printing. The ink jet head 11 is carried on a carriage 3 which is mounted movably on a pair of parallel guide rails 2, 2. While being reciprocated with reciprocating motion of the carriage 3, the ink jet head 11 performs printing on a platen plate 7 for printing paper 6 which is conveyed in the direction orthogonal to the reciprocating direction of the carriage 3 while being held between a conveyance roller 4 and an auxiliary roller 5.

In a position deviated from a printing area defined by the moving path of the ink jet head 11 is disposed a wiping device 8 (wiping means) having wiping paper 8A (wiper member) which is brought into contact with the nozzle surface of the ink jet head 11 to wipe the nozzle surface. According to the construction of the wiping device 8, the wiping paper 8A which is a sheet-like wiping medium is accommodated within a casing 8B and for a wiping operation it is pushed out up to a position where it contacts with the nozzle surface of the ink jet head 11 by push-out means (e.g. solenoid, not shown), then is moved relative to the nozzle surface while being brought into close contact with the nozzle surface, thereby cleaning the same surface. More specifically, the wiping device 8 is connected to a controller 25 which controls the ink jet printer 1, and the operation thereof is controlled by wiping control means 24 provided in the controller 25 (see FIG. 7).

In the wiping device 8, the wiping paper 8A is wound in the shape of a roll around a roll shaft 8D and performs the wiping operation through an open window 8C. The wiping paper 8A after use is wound and recovered successively via a guide shaft onto a take-up shaft 8E which is rotated by drive means. The wiping operation by the wiping device 8 is performed not only when the power supply is turned ON for the start of printing but also when a wiper switch (not shown) is turned ON.

Figure 2:
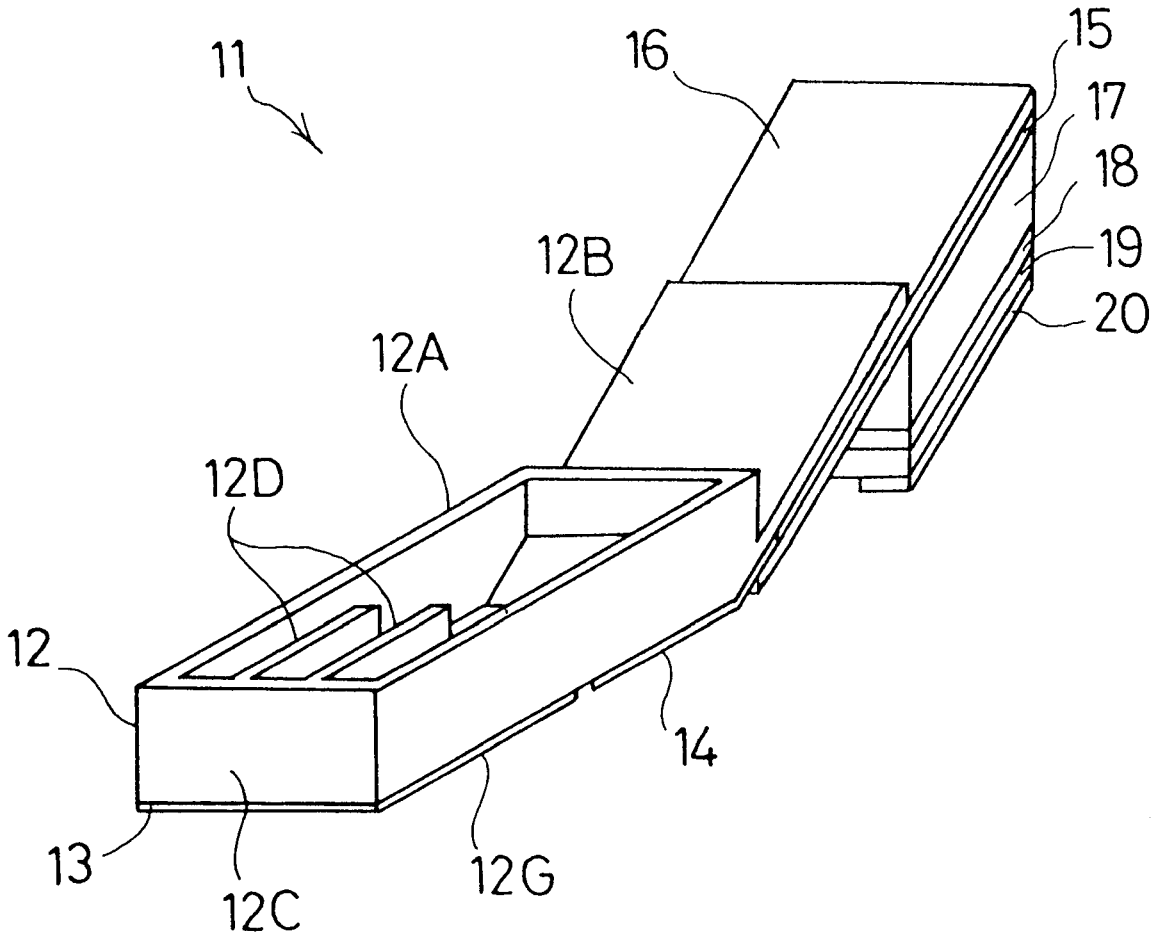
FIG. 2 is a perspective view of a hot melt type ink jet head used in the ink jet printer.
Figure 7:
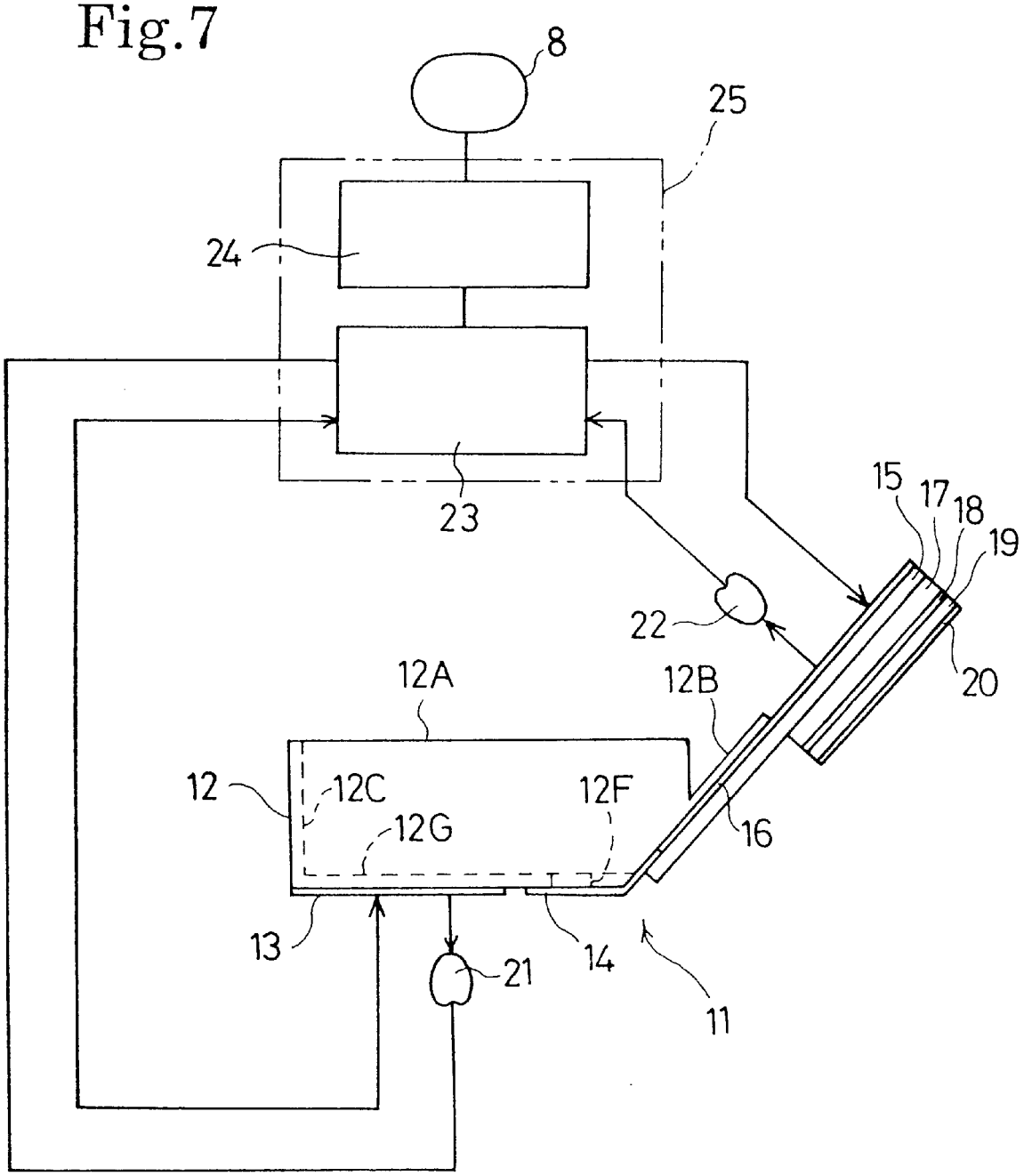
FIG. 7 is an explanatory diagram of a control system for the ink jet head.

As shown in FIG. 2 and FIG. 7, the ink jet head 11 has a hollow ink tank 12 for the storage of a solid ink therein. The ink tank 12 has an ink tank body 12A which is generally in the shape of a rectangular parallelepiped and with an ink supply port 12F being formed on one side of a bottom 12G. On the side where the ink supply port 12F is formed, the lower half of the outer side surface is formed as an inclined surface, and a flat plate-like extending portion 12B extends from the inclined surface. On the opposite side of the tank body 12A, two parallel ribs 12D, 12D contiguous to both side wall 12C and the bottom 12G are formed upright in the interior of the tank body.

Further, a tank heater (ceramic heater) 13 for heating the ink stored in the ink tank 12 is fixed to the bottom portion of the tank body 12A on the side where the ribs 12D, 12D are formed.

By forming the ribs 12D, 12D in the tank body 12A to partition the interior of the tank, the heat from the tank heater 13 is fed into the tank efficiently and the solid ink stored therein is thereby heat-melted efficiently.

A connection member 14 of an L-shaped section having an ink passage communicating with the ink supply port 12F is attached to the inclined surface of the ink tank 12, and a first base plate 15 having an ink passage communicating with the ink passage of the connection member 14 is connected fixedly to the inclined surface through the connection member 14.

On the upper surface side (ink tank 12 side) of the first base plate 15 is disposed a front heater 16 for heating the upper surface side (back side) of a nozzle (nozzle plate 20 as will be described later). The front heater 16 extends from the upper end portion of the first base plate 15 up to near the upper end portion of the connection member 14 via the underside of the extending portion 12B.

Figure 3:
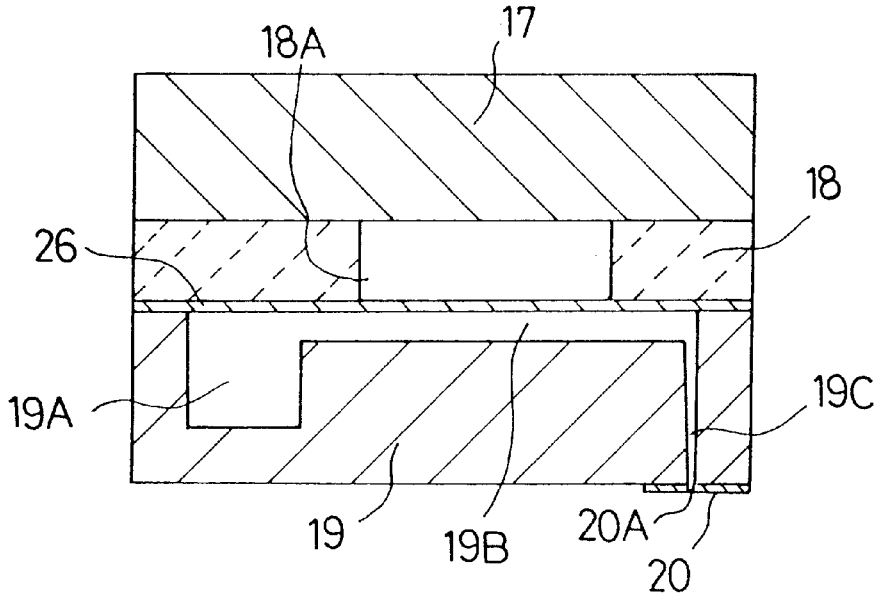
FIG. 3 is a diagram showing a schematic construction of a principal portion of the ink jet head.
Figure 4:
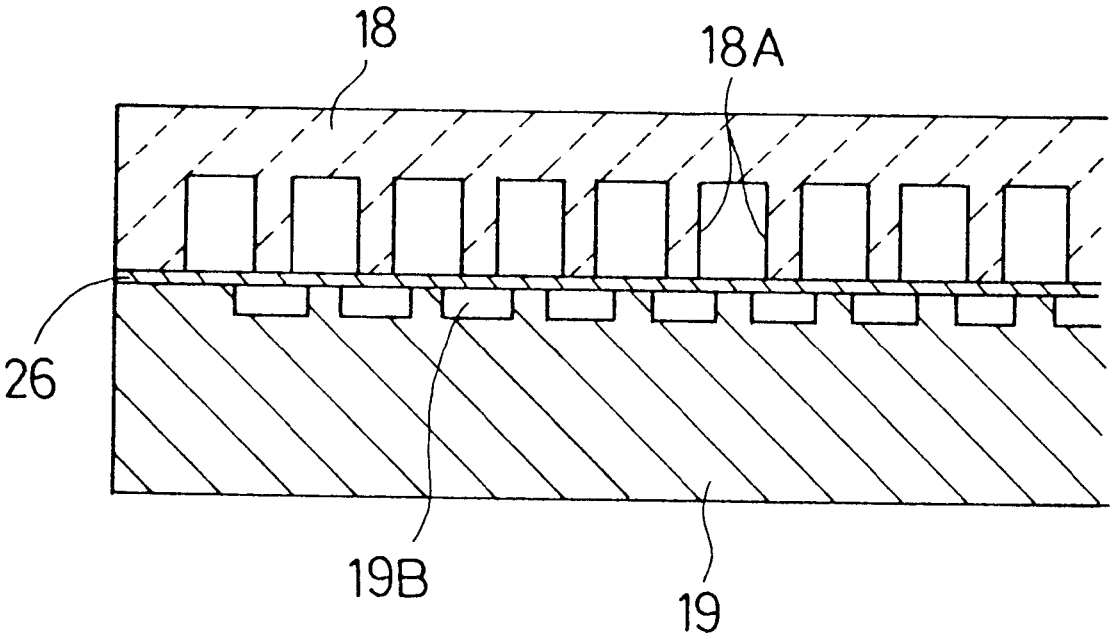
FIG. 4 is a sectional view showing a relation between a piezoelectric element and a cavity plate.
Figure 5:
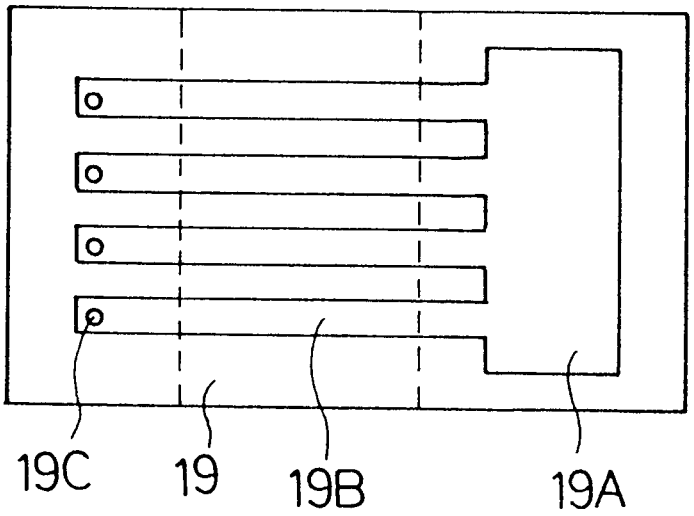
FIG. 5 is an explanatory diagram of the cavity plate.

To the underside of the first base plate 15 is fixed a second base plate 17 over an area from the upper end portion of the first base plate 15 to the position corresponding to the upper end of the extending portion 12B. Further, to the underside of the second base plate 17, as shown in FIGS. 3 and 4, are fixed a piezoelectric element 18 (PZT—lead-zirconium-titanate) having drive portions 18A for the ejection of ink, a cavity plate 19 (see FIG. 5) which forms cavities (ink supply chamber 19A, ink passages 19B and ink discharge ports 19C) for ink ejection, and a nozzle plate 20 having orifices 20A, successively in this order.

Figure 6:
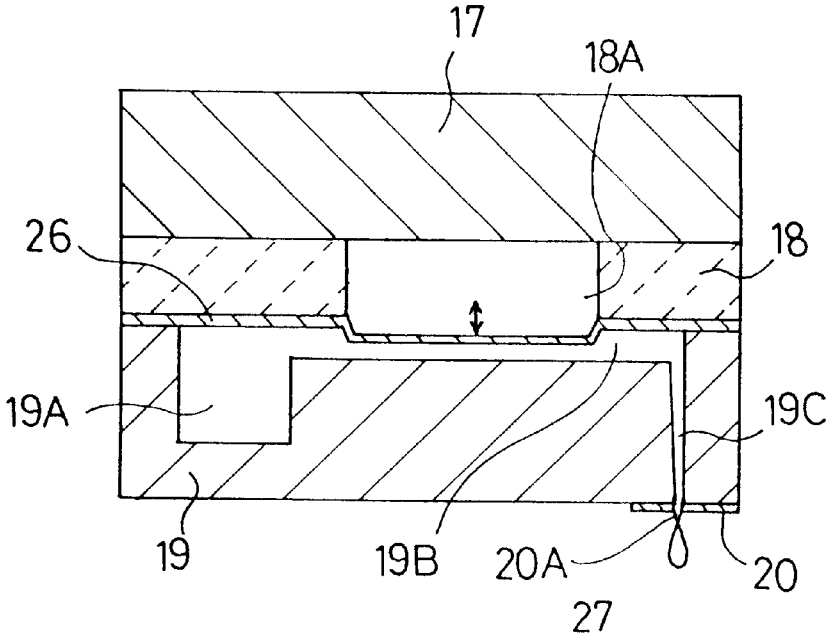
FIG. 6 is a diagram explaining the operation of the ink jet head.

A diaphragm 26 having flexibility is interposed between the piezoelectric element 18 and the cavity plate 19. When the drive portions 18A of the piezoelectric element 18 are displaced and press the ink passages 19B through the diaphragm 26, ink drops 27 are ejected through the orifices 20A (see FIG. 6).

As shown in FIG. 7, temperature sensors (e.g. thermistors) 21 and 22 are provided to the tank heater 13 and the front heater 16, respectively, and are connected to heater control means 23 in a controller 25 which controls the heating temperatures of both heaters 13 and 16 to respective predetermined levels in accordance with temperature signals provided from both temperature sensors 21 and 22. The heater control means 23 makes control so that the ink temperature in the ink jet head 11 including the ink tank 12 reaches a target ink temperature. The "target ink temperature" indicates a temperature at which the viscosity of the ink reaches a value (3 to 50 cPs, preferably 5 to 20 cPs) suitable for the ejection of ink as drops.

In addition to such normal temperature control, the heater control means 23 makes another control whereby during the wiping operation (from the start to the end of the wiping operation) the electric power to be fed to the front heater 16 is increased as compared with that in the normal temperature control. As a result, the drop of ink temperature in the nozzle portion during the wiping operation is suppressed.

Figure 8:
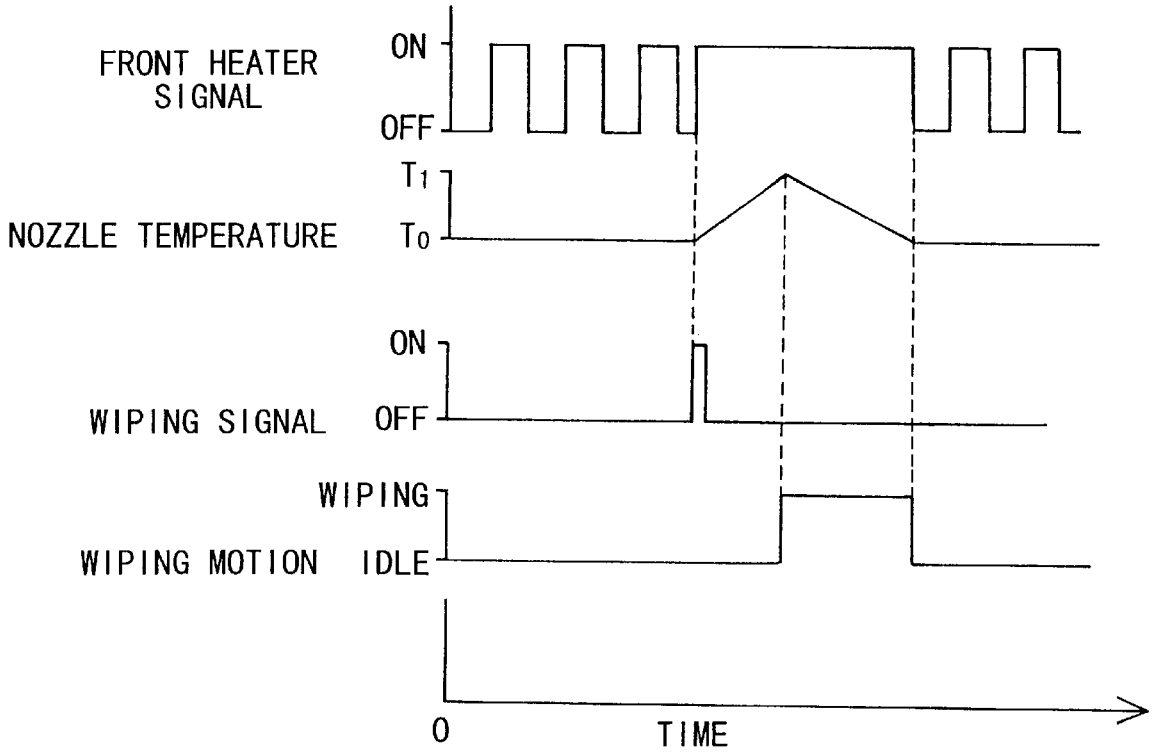
FIG. 8 is a time chart showing a relation among a front heater signal, nozzle temperature, a wiping signal, and a wiping operation.

According to the above construction, in the normal operation not involving the wiping operation, as shown in FIG. 8, the front heater 16 is duty-controlled by the heater control means 23 in accordance with a front heater signal which is constant in the duty ratio as an ON-OFF time ratio, whereby the ink temperature (nozzle temperature) in the nozzle portion is maintained almost constant.

On the other hand, the wiping operation is controlled in the following manner.

When a wiper switch (not shown) is turned ON, an electric current is supplied to a motor (not shown) which drives the carriage 3, under the control made by the wiping control means 24, so that the ink jet head 11 is moved to the position where it is confronted with the wiping device 8. Then, by push-out means (not shown), the wiping paper 8A is pushed against the nozzle surface of the ink jet head 11 through the open window 8C and moves toward the take-up shaft 8E while being in contact with the nozzle surface. As the wiping paper 8A thus moves on the nozzle surface, stains such as ink sediment are wiped off.

Upon turning ON the wiper switch referred to above, a wiping signal (pulse signal) is output from the wiping control means 24 to the heater control means 23, which in turn increases the duty ratio of the front heater signal only for a predetermined certain time in advance of the actual wiping operation. More specifically, the duty ratio is set at 100% and the front heater 16 is kept ON (current flowing state) to thereby increase the electric power to be fed to the front heater 16 and hence increase the amount of heat produced. This is because the ink temperature in the nozzle portion drops by about 2° C. or so as a result of the wiping operation (such as a single wiping operation that takes several seconds) and in order to prevent the resulting solidification or increase in viscosity of the ink it is necessary to control the heater temperature higher by 2° C. or more before the start of the actual wiping operation after the input of the wiping signal. But it is not always necessary that the increase of the amount of heat produced by the front heater 16 be conducted prior to the wiping operation. If only the amount of heat produced by the front heater 16 is increased at least during the wiping operation, it is possible to somewhat prevent the drop of the ink temperature in the nozzle portion.

With increase in the amount of heat produced by the front heater 16, the nozzle temperature rises gradually up to a level which is higher than the normal nozzle temperature. When in this state the wiping operation is started by the wiping device 8, the heat in the nozzle portion is removed by contact of the nozzle portion with the wiping paper 8A. But the nozzle temperature does not become lower than the normal level because it is held in a higher state than in the normal operation.

After the wiping operation has been conducted for a predetermined certain time, the duty ratio of the front heater signal is returned to the normal value and duty control is performed so that the nozzle temperature is again held at the normal constant level.

Figure 9:
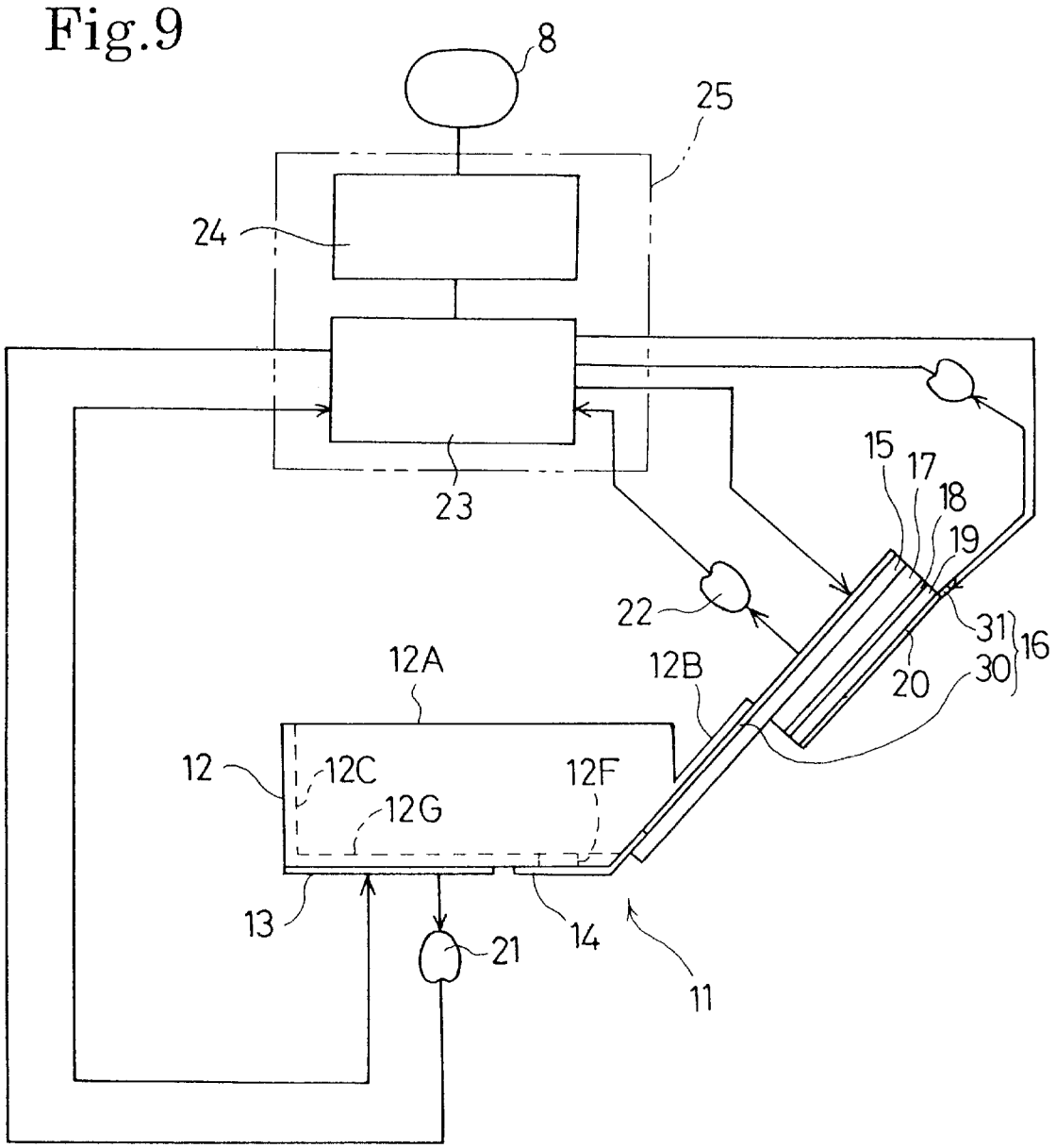
FIG. 9 is an explanatory diagram of an ink jet head control system according to a modification of the present invention.

Thus, in the above embodiment the electric power to be fed to the single front heater 16 is increased to increase the amount of heat produced by the front heater 16. But in order to control heating more efficiently, the front heater 16 may be constituted as shown in FIG. 9 by both a main heater 30 for maintaining the ink in the ink jet head always in a melted state and a sub-heater 31 for heating the nozzle portion. In this case, an electric current is normally supplied to only the main heater 30 to obtain a predetermined amount of heat under the control made by the heater control means 23, while upon receipt of a signal from the wiping control means 24 the heater control means 23 makes control so that an electric current is supplied not only to the main heater 30 but also to the sub-heater 31 to increase the amount of heat produced.

What is claimed is:

1. An ink jet printer comprising:

an ink jet head comprising an ink tank for storing a solid ink therein and a nozzle for ejecting a liquid ink resulting from heating and melting the solid ink through an ejection end of the nozzle to effect printing;

a wiping device having a wiper member that performs a wiping operation to clean a nozzle surface of said ink jet head;

a wiping controller that electrically controls the wiping operation of said wiping device;

a heater that heats a nozzle portion of said ink jet head; and a heater controller which upon receipt of a signal from said wiping controller increases an amount of heat produced by said heater;

wherein in advance of the wiping operation, the heater controller receives the signal from the wiping controller and increases the amount of heat produced by the heater, and before and during the wiping operation, the heat produced by the heater maintains the temperature of the liquid ink in the nozzle at a level wherein the liquid ink is maintained in a molten state suitable for ejection of the liquid ink during and following the wiping operation.

2. An ink jet printer as claimed in claim 1, wherein upon receipt of a signal from said wiping controller, said heater controller increases electric power fed to said heater in advance of the wiping operation.

3. An ink jet printer according to claim 1, wherein said heater has a main heater for maintaining in a melted state the ink stored in said nozzle portion and a sub-heater for heating a ejection end of the nozzle portion, and said heater controller causes said main heater to operate normally and causes said sub-heater to operate upon receipt of a signal from said wiping controller.

4. An ink jet printer as claimed in claim 1, wherein upon receipt of a signal from said wiping controller said heater controller increases electric power fed to said heater at least before or during the wiping operation.

5. An ink jet printer as claimed in claim 1, wherein said wiper member cleans the nozzle surface by moving a sheet-like wiping medium relative to the nozzle of said ink jet head while keeping the sheet-like wiping medium in close contact with the nozzle surface.

6. An ink jet printer as claimed in claim 1, wherein said heater controller means controls said heater such that a temperature of said ink in said ink jet head immediately after said wiping operation is a temperature of said ink in said ink jet head prior to said wiping operation.

7. An ink jet printer as claimed in claim 1, wherein said heater comprises a main heater to heat said nozzle portion of said ink jet head, and said heater controller comprises a heat sensor connected to said heater.

8. An ink jet printer as claimed in claim 7, further comprising a tank heater for maintaining in a melted state the ink stored in said tank of said ink jet head.

9. An ink jet printer as claimed in claim 1, wherein said heater comprises a main heater to heat said nozzle portion of said ink jet head and a sub-heater to heat ink in said ejection end of said nozzle portion, and said heater controller comprises a first heat sensor connected to said main heater and a second heat sensor connected to said sub-heater.

10. An ink jet printer as claimed in claim 9, further comprising a tank heater for maintaining in a melted state the ink stored in said tank of said ink jet head.

11. An ink jet printer comprising:

an ink jet head comprising an ink tank and at least one nozzle;

a wiping means for cleaning a surface of said nozzle of said ink jet head;

a wiping control means for electrically controlling an operation of said wiping means;

a heating means for heating a nozzle portion of said ink jet head; and a heating controller in communication with said wiping control means which increases an amount of heat produced by said heating means on receipt of a signal from the wiping control means to offset a temperature loss in said nozzle during a wiping operation, wherein in advance of the wiping means cleaning the surface of the nozzle, the heating controller receives the signal from the wiping controller and increases the amount of heat produced by the heating means, and before and during the wiping means cleaning the surface of the nozzle, the heat produced by the heating means maintains the temperature of the liquid ink in the nozzle at a level wherein the liquid ink is maintained in a molten state suitable for ejection of the liquid ink during and following the wiping operation.

12. An ink jet printer as claimed in claim 11, wherein said ink jet head further comprises a tank heater for maintaining in a melted state ink stored in said ink tank.

13. An ink jet printer as claimed in claim 11, further comprising:

a first guide rail, wherein said ink jet head is slidably mounted to said first guide rail; and a head controller for moving said ink jet head forward and backward along said first guide rail;

wherein said wiping means is disposed in a position dislocated from a print area of a travel route of said ink jet head;

and wherein printing is conducted by moving said ink jet head along said first guide rail within said print area to print information on a recording medium.

14. An ink jet printer as claimed in claim 11, wherein said heating controller increases power to be fed to said heating means at least before or during the wiping operation.

15. An ink jet printer as claimed in claim 11, wherein said heating controller increases an amount of heat produced by said heating means at least before or during the wiping operation.

16. An ink jet printer as claimed in claim 11, wherein said wiper member cleans the nozzle surface by moving a wiping medium relative to the nozzle of said ink jet head while keeping the wiping medium in close contact with the nozzle surface.

17. An ink jet printer as claimed in claim 11, wherein said heating means comprises a first heater to heat a nozzle portion of said ink jet head and a second heater to heat an ejection end of said ink jet head, said heating controller comprising a first heat sensor connected to said first heater and a second heat sensor connected to said second heater.

18. An ink jet printer as claimed in claim 11, wherein said heating means maintains a temperature in said nozzle such that ink in said nozzle maintains a viscosity of from 3 to about 50 cPs during the wiping operation.

19. An ink jet printer comprising:

an ink jet head comprising an ink tank for storing a solid ink therein and a nozzle for ejecting a liquid ink resulting from heating and melting the solid ink through an ejection end of the nozzle to effect printing;

a wiping device having a wiper member that performs a wiping operation to clean a nozzle surface of said ink jet head;

a wiping controller that electrically controls the wiping operation of said wiping device;

a heater that heats a nozzle portion of said ink jet head; and a heater controller which upon receipt of a signal from said wiping controller increases an amount of heat produced by said heater at least before or during the wiping operation, wherein said heater controller controls the heating temperature of said heater by duty control and increases a duty ratio of a duty signal at least before or during the wiping operation.

20. An ink jet printer comprising:

an ink jet head comprising an ink tank and at least one nozzle;

a wiping means for cleaning a surface of said nozzle of said ink jet head;

a wiping control means for electrically controlling an operation of said wiping means;

a heating means for heating a nozzle portion of said ink jet head; and a heating controller in communication with said wiping means which increases an amount of heat produced by said heating means upon receipt of a signal from the wiping control means to offset a temperature loss in said nozzle during a wiping operation, wherein said heating controller controls a heating temperature of said heating means by duty control and increases a duty ratio of a duty signal at least before or during the wiping operation.

* * * * *